US011305178B2

(12) United States Patent
Hench

(10) Patent No.: US 11,305,178 B2
(45) Date of Patent: Apr. 19, 2022

(54) CHESS VARIANT INCLUDING ADDITIONAL PLAYER PIECE AND METHOD OF PLAY

(71) Applicant: John Josef Hench, Los Gatos, CA (US)

(72) Inventor: John Josef Hench, Los Gatos, CA (US)

( * ) Notice: Subject to any disclaimer, the term of this patent is extended or adjusted under 35 U.S.C. 154(b) by 104 days.

(21) Appl. No.: 17/013,621

(22) Filed: Sep. 6, 2020

(65) Prior Publication Data

US 2021/0154567 A1 May 27, 2021

Related U.S. Application Data

(60) Provisional application No. 62/939,656, filed on Nov. 24, 2019.

(51) Int. Cl.

| | |
|---|---|
| ***A63F 3/02*** | (2006.01) |
| ***A63F 11/00*** | (2006.01) |
| ***A63F 3/00*** | (2006.01) |

(52) U.S. Cl.

CPC ..... *A63F 3/02* (2013.01); *A63F 11/0074* (2013.01); *A63F 2003/007* (2013.01); *A63F 2003/00826* (2013.01); *A63F 2011/0086* (2013.01)

(58) Field of Classification Search

CPC .. A63F 3/02; A63F 11/0074; A63F 2003/007; A63F 2003/00826; A63F 2011/0086; A63F 3/00697

See application file for complete search history.

(56) References Cited

U.S. PATENT DOCUMENTS

| | | | | |
|---|---|---|---|---|
| 4,033,586 | A * | 7/1977 | Corinthios | A63F 3/02 273/260 |
| 5,511,793 | A * | 4/1996 | Watt | A63F 3/00697 273/261 |
| 5,690,334 | A * | 11/1997 | Duke | A63F 3/02 273/261 |
| 5,901,957 | A * | 5/1999 | Leyva | A63F 3/00176 273/261 |
| 6,095,523 | A * | 8/2000 | Lampman | A63F 3/02 273/261 |
| 6,446,966 | B1 * | 9/2002 | Crozier | A63F 3/00697 273/261 |
| 6,481,716 | B2 * | 11/2002 | Trice | A63F 3/00176 273/242 |
| 7,434,806 | B2 * | 10/2008 | Budden | A63F 3/02 273/261 |
| 2012/0112411 | A1 * | 5/2012 | Spurgeon | A63F 3/02 273/260 |
| 2013/0157740 | A1 * | 6/2013 | Louie | A63F 3/02 273/261 |
| 2015/0321080 | A1 * | 11/2015 | Archer | A63F 3/02 463/14 |

* cited by examiner

*Primary Examiner* — Michael D Dennis

(57) ABSTRACT

A chess variant includes (a) one of an 8 by 8 board, a 8 by 10 board, or a 10 by 10 board; (b) a conventional chess piece set; and (c) a novel non-conventional chess piece set, wherein the pieces of the non-conventional chess piece set perform non-standard movements with rules associated therewith to govern how the pieces move and capture upon the board. Additionally, the set of rules governing how the rules of movement for the piece can undergo a change when a non-conventional chess piece reaches the furthest rank, akin to the process of promotion in standard chess.

18 Claims, 6 Drawing Sheets

Mounted
Squire
Or
“Squire"

Dismounted
Squire
Or
“Knave"

CHESS VARIANT INCLUDING ADDITIONAL PLAYER PIECE AND METHOD OF PLAY

CROSS REFERENCE TO RELATED APPLICATION

The present application for patent claims priority under 35 U.S.C. § 119 from U.S. provisional patent application Ser. No. 62/939,656, filed Nov. 24, 2019, the subject matter of which is incorporated herein by reference in its entirety.

TECHNICAL FIELD

The present invention relates to chess games and, more specifically, to a chess variant and method of play thereof.

BACKGROUND INFORMATION

The game of chess is well-known, dating back several hundred years by most accounts. Conventional chess is a two-player game played on a chessboard having sixty-four alternating black and white squares comprising eight horizontal rows called ranks, and eight vertical columns called files. In conventional chess, each player begins the game with sixteen movable game pieces as follows: one King (K), one Queen (Q), two Rooks (R), two Bishops (B), two Knights (Kn) and eight Pawns (P). The object of conventional chess is to "checkmate" the opposing player's King, i.e., to place the King in a position such that he cannot escape being captured in the subsequent move. Each player's pieces are initially positioned in a predetermined opposed and mirrored relation to his opponent's pieces, with his Pawns occupying his second rank and the remaining pieces occupying his first rank. The players alternate turns by moving any one of their pieces to a different square on the chess board according to predefined movement rules. A player captures his opponent's pieces during a turn by moving his piece into a square occupied by one of the opponent's pieces. The rules associated with conventional chess are well known and are generally outlined in U.S. Pat No. 20060113728A1 to Budden, U.S. Pat. No. 5,735,523 to Fioriglio and U.S. Pat. No. 5,690,334 to Duke, which are hereby incorporated in their entirety by reference.

By rule, each game piece in classical chess has limitations placed upon its movement. For example, the King generally may move one square in any direction (e.g. orthogonally or diagonally) to an unobstructed square. The Queen may move through any number of unobstructed squares in any straight line (e.g. orthogonally or diagonally). The Queen may not jump other pieces. The Rook may move orthogonally through any number of unobstructed squares in a straight line. The Rook may not jump other pieces. The Bishop may move through any number of unobstructed squares in any straight diagonal line. The Bishop may not jump other pieces. The Knight makes a move which consists of a first one-square step in an orthogonal direction and a second one-square step diagonally away from his original position. The Knight may jump other pieces to arrive at his destination. With the following two exceptions, the Pawn may only move forward one square provided his path is unobstructed, that is, if an opponent's piece in not placed in his intended direction of travel. First, on its initial move, the Pawn may move forward one or two squares. Second, the Pawn may move one square diagonally forward if he captures an opponent's piece.

It should be noted that in conventional chess, other variant moves are permitted under limited circumstances, such as "castling" moves and "en passant" capture moves. Castling involves the simultaneous movement of the King and the Rook. Several castling moves are known. For example, in one castling move the King moves horizontally along a row two squares inward toward the Rook, and the Rook moves horizontally over and beyond the King to the next adjacent square in that row. An en passant capture is a move executed by the Pawn in which the Pawn attacks an opposing Pawn, the opposing Pawn having just been advanced two squares from its original square in one move. In such circumstances, the attacking Pawn may move diagonally one square into the square passed over by the opposing Pawn and capture the Pawn.

In addition to classical chess, many alternative versions of chess have developed throughout the years. For example, U.S. Pat. No. 6,702,287 to Pendexter and U.S. Pat. No. 6,481,716 to Trice discloses exemplary variations on conventional chess. However, these prior art chess variants require a non-standard sized chess board to accommodate new pieces. Thus, a player is usually required to carry the non-standard sized chess board to the locale at which he wishes to play. Thus, it is desirable to provide a chess variant that may utilize traditionally-sized chessboards, while maintaining interesting and effective playability.

Although non-standard sized boards offer enhanced playability, the games pieces and set of rules for a particularly sized board are applicable only to that board and may not be ported to boards of other sizes or configurations. Thus, once a player becomes familiar with the underlying rules of the chess variant corresponding to a board of a given size, the rules and game-play knowledge acquired by playing that chess variant is inapplicable to other chess variants. This is often a stumbling block, requiring the player to learn new rules and strategies for other chess variants, as opposed to building upon his existing experience and knowledge. Thus, it is desirable to provide a chess variant that maintains a closely related underlying set of rules and game pieces that may be applied to both a traditional chess board as well as various non-standard sized boards.

Additionally, a need exists to minimize the complexity and learning curve of the chess variant that is sought to be played, thereby increasing the appeal of the chess variant to a wider audience. Furthermore, although prior art chess variants are playable, they may not necessarily be played strategically, as the players are not aware of the value and strength of each new piece in relation to the non-standard board size or configuration. Thus, prior art chess variants are not fully optimized to encompass more strategic levels of game-play.

In the past, many chess variants introduced new pieces whose rules are a combination of the moves of standard chess pieces, rendering them more powerful than most of the standard pieces. This reduces the playability or the strategic depth of the variant, as the pieces provide too many avenues of attack, reduce the tactical importance of Pawns, or minimize the negative overall effect of the capture of pieces whose moves to which the new pieces are derived. This was the case in a variant commonly referred to as Capablanca Chess, invented in the early 20th century, in which the two new pieces, the Chancellor and the Archbishop combined the moves of the a Rook and a Knight and a Bishop and a Knight, respectively, thus tipping the strategic balance of the game towards these powerful new pieces.

As shown, a need exists for a new and improved chess variant that is a logical extension of ordinary or conventional chess but utilizes new pieces in conjunction with standard or non-standard sized chess boards to provide new challenges to conventional opening moves, capture strategies, promotions, etc.

SUMMARY

A chess variant includes (a) one of an 8 by 8 board, a 8 by 10 board, or a 10 by 10 board; (b) a conventional chess piece set; and (c) a novel non-conventional chess piece set, wherein the pieces of the non-conventional chess piece set perform non-standard movements with rules associated therewith to govern how the pieces move and capture upon the board. Additionally, the set of rules governing how the rules of movement for the piece can undergo a change when a non-conventional chess piece reaches the furthest rank, akin to the process of promotion in standard chess. The movement and capture rules associated with a new separate chess piece include many subvariants as described herein.

The foregoing is a summary and thus contains, by necessity, simplifications, generalizations and omissions of detail; consequently, those skilled in the art will appreciate that the summary is illustrative only and is not limiting in any way. Other aspects, inventive features, and advantages of the devices and/or processes described herein will become apparent in the non-limiting detailed description set forth herein.

DETAILED DESCRIPTION

Reference will now be made in detail to background examples and some embodiments of the invention, examples of which are illustrated in the accompanying drawings.

The present invention introduces a new approach to ordinary or conventional chess gaming by implementing, generally, a new piece and its corresponding movement, capture strategies, and graduative rules associated therewith.

The inventor has discovered that a more strategic and interesting chess variant emerges when a new piece is introduced whose movement rules render it less powerful than standard pieces, rather than more powerful than standard pieces. This keeps the combinatorics of the additional move permutations in check, as well as maintains the strategic balance and tactics of the standard pieces that are used in the variant.

Figure 1:
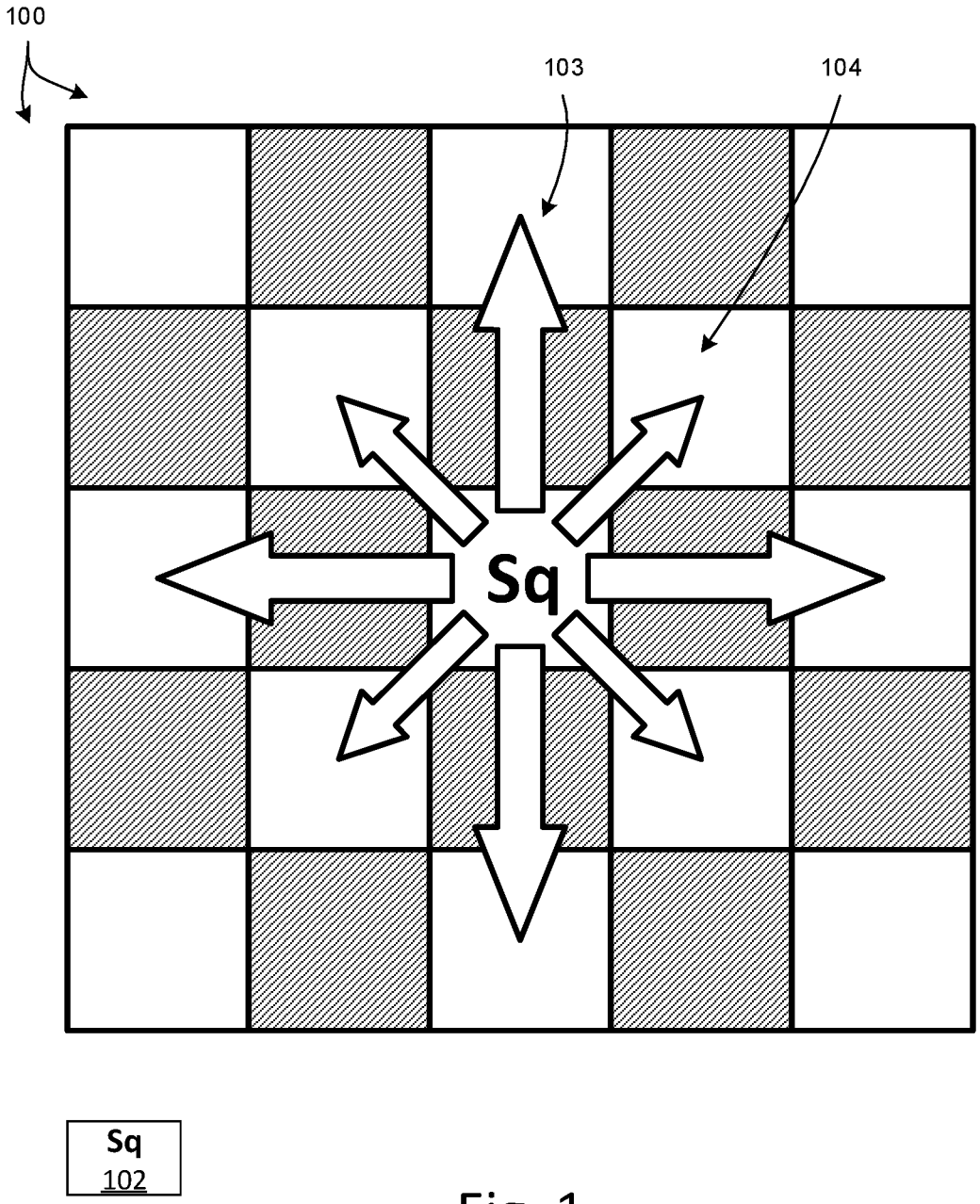
FIG. 1 is a diagram illustrative of potential moves by a novel non-conventional chess piece.

As with conventional chess, the game is played on a board of alternate colored tiles 100 as shown in FIG. 1, with the object of the present invention being to checkmate one's opponent's King (K). Also, as in conventional chess, one makes the distinction between units that are pieces and units that are non-pieces, with Pawns being the only non-pieces. In this chess variant, an additional piece is proposed: the Squire, denoted by digraph "Sq" 102. The Squire, historically, is the title of a Knight's apprentice or shield bearer. The implication for this variant of chess is that the movement and capture rules for a Squire is both related to the Knight and is less powerful than a Knight, that is, its relative strategic value is less than a Knight.

The rules of movement for a Squire are shown diagrammatically in FIG. 1. It consists of an orthogonal move 103 of two squares (left, right, forward or backward) or a diagonal move 104 of one square. This template of moves is the most important and novel feature of the Squire. Because of these movement rules, the Squire, like the Bishop, will remain on the same color square for the entire game. Strategically, it allows for a defensive strategy similar to that when only one Bishop remains on the board; namely, to place pieces to opposite color squares whenever possible. Furthermore, it provides an interesting interplay where the only two pieces remaining are the Squire and the Bishop. In such a case the strategic situation is dramatically different if the Squire and the Bishop occupy the same or opposite color squares, particularly in an end-game. Another aspect of these movement rules is that it, in a sense, is complementary to the Knight. The set of squares to which the squire is allowed to move is within a three by three block of squares adjacent to the current position of the Squire.

A further aspect of the movement rules of the Squire is that while its strategic value is relatively low as an offensive piece due to its limited range and capture rules, its weakness is compensated by its strength as a defensive piece. The reason for this is that by moving two squares across a row or column of the piece it is defending, it can maintain the defense of said piece. This aspect of the Squire could, for example, be used to strongly stabilize Pawn islands or permit a Knight to more easily retain a centralized position in the game.

Another novel aspect of the Squire is that there are potentially two different categories of the orthogonal movement of two squares. For the first type, the move of two squares orthogonally is accomplished what may be described as a march. Like a pawn, a marching move can be blocked by another piece if it is placed directly in the path of two-square move, that is, orthogonally adjacent to the Squire in the direction of the intended move. Furthermore, for this move, it is possible to introduce a rule to allow the Squire to be captured en passant by another piece or pawn. The second type of orthogonal moves is that of a jump, much like a Knight. In this case it can move two squares regardless of its adjacent neighbors. It is useful to make a titular distinction between the two, wherein the former case the Squire is denoted as a Dismounted Squire, and in the latter as a Mounted Squire, or perhaps more simply as a Squire (mounted) or a Knave (dismounted). It is anticipated that in practice the simpler single word appellation of the latter will garner more widespread use. For the purpose of precision, however, this document will use Squire to be inclusive of both Mounted and Dismounted Squires.

A third novel aspect of the Squire is that, like a Pawn, it is possible to introduce a rule by which only a predetermined subset of a move template belongs to capturing moves. Capturing moves are defined as moves that are allowed only if another piece is captured, as opposed to positional moves, which are defined as moves wherein another piece is not captured. It should not be construed that the set of allowable capturing moves for the Squire are disjoint from the set of positional moves. Indeed, for all (non-pawn) pieces in standard chess, the template of allowable capturing moves is identical to positional moves. For Pawns, the templates are disjoint, with diagonal moves being capturing and forward moves being positional.

For the Squire, a novel approach is taken such that the set of positional and capturing moves need not be either identical or mutually disjoint. In one embodiment, all eight positional moves are permitted while only allowing the four diagonal capturing moves. In this embodiment, diagonal moves can be either positional or capturing. In another embodiment, only the four orthogonal moves are positional while the four diagonal moves are capturing. In this embodiment, a diagonal move is only allowed if an opponent's piece is captured. The effect of allowing diagonal moves to be both positional and capturing provides the Squire with greater mobility, giving the piece greater relative strategic strength than if the diagonal moves were only capturing. Because the basic template for the movement of the Squire has eight potential moves, there are many potential subsets of positional and capturing moves. Clearly, because there are eight potential moves for the Squire, it is not expedient to list all of the potential restrictions on capturing and positional moves that the combinatorics allow; however, a subset of sensible restrictions on a standard set of moves will likely improve the strategic impact of the Squire in the chess variant.

Figure 2:
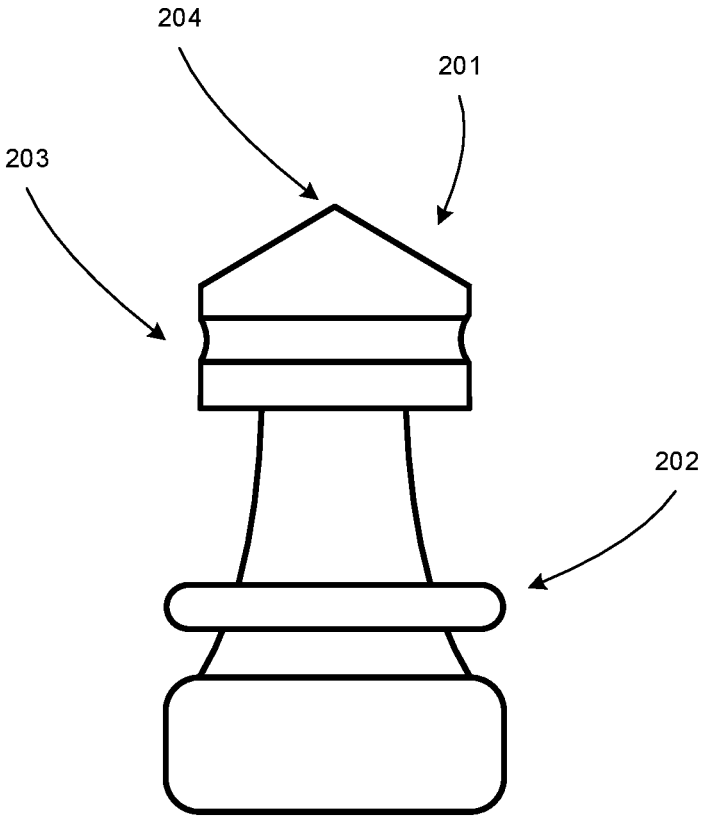
FIG. 2 depicts a proposed cylindrically symmetric design of a variant of a novel non-conventional chess piece in one embodiment.
Figure 3:
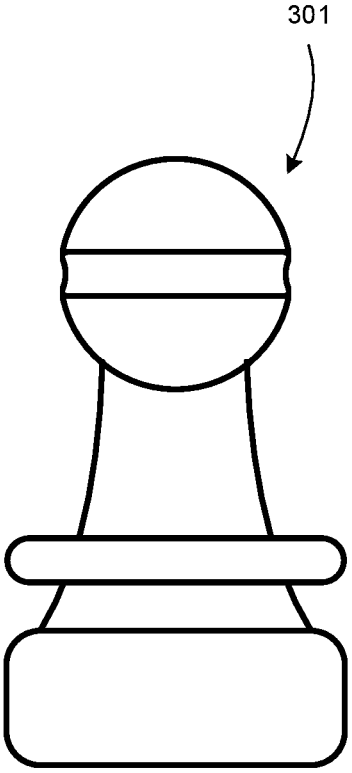
FIG. 3 depicts a proposed cylindrically symmetric design of a variant of a novel non-conventional chess piece in another embodiment.
Figure 4:
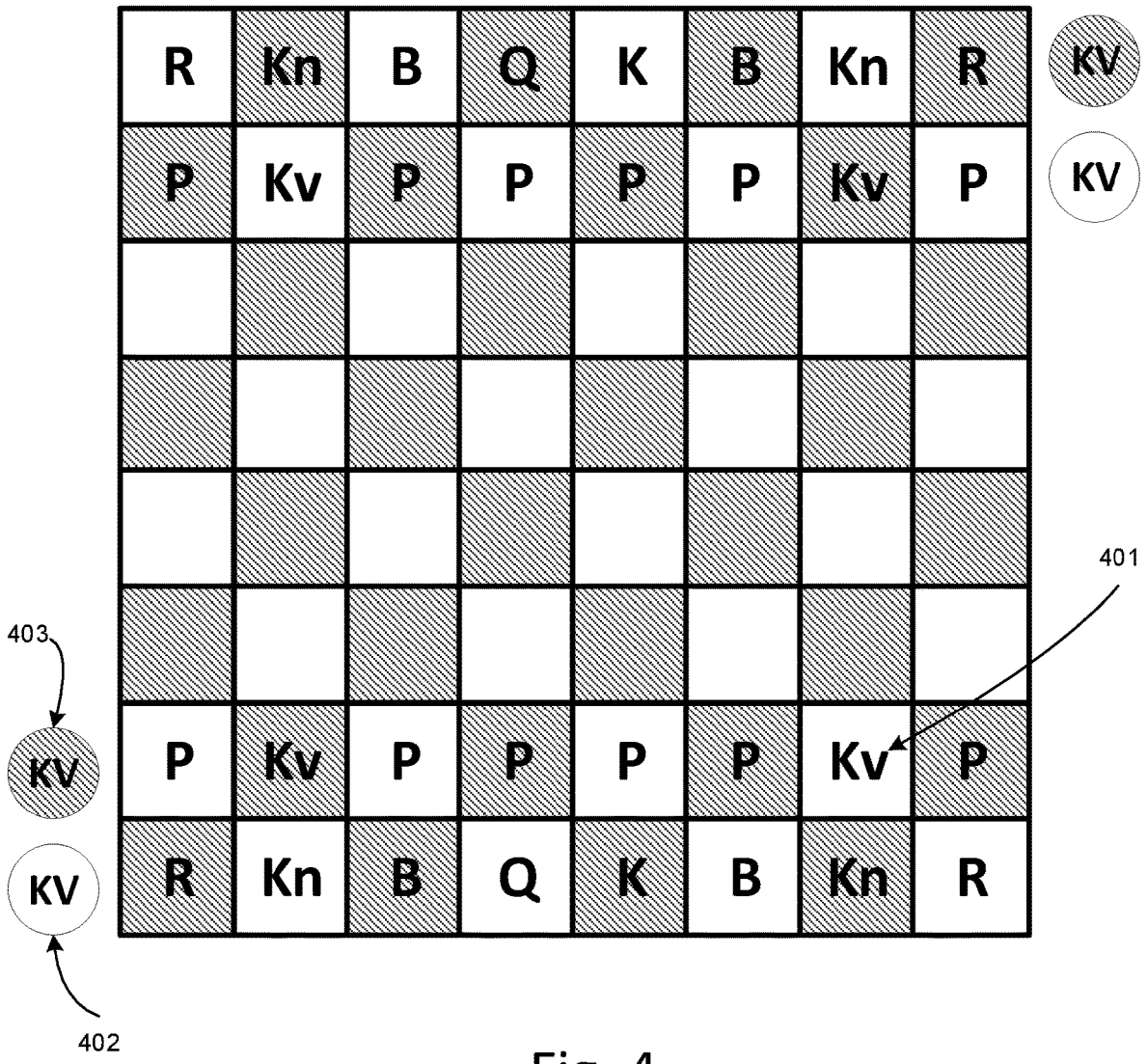
FIG. 4 depicts an initial layout of an eight by eight chess board with a novel non-conventional chess piece as well as tokens depicting different states associated with the novel non-conventional chess piece; each state representing a different set of movement rules.

A final novel aspect of the Squire is that, like a Pawn, it has a rule governing a process that is not unlike promotion. For the purposes of clarity, this process is named graduation, thereby distinguishing it from the process of promotion in classical chess. Like a Pawn, graduation occurs when the Squire reaches the final rank. Unlike a Pawn, however, the process of graduation does not replace the Squire with another piece; rather, it changes the Squire's type from Dismounted to Mounted Squire, thereby indicating a change in capturing rules, positional movement rules, or both. One way to designate the occurrence of graduation is to provide designs consisting of two pieces that are similar in shape. For example, in the nominal design of the Squire, the piece is roughly the height of a Rook, but similar in shape with the Pawn. There are two design aspects of the piece, shown in FIG. 2, that are unique: the visor 201 and the baldric, or belt 202. The visor 201 imparts a grooved cylindrically symmetric head 203 to the piece with an oblique conical top 204. A potential way to distinguish between the two might be to have the Mounted Squire retain a visor 201 while the Dismounted Squire has a grooved round head 301, as depicted in FIG. 3. Another means of distinguishing the two is to make the baldric 202 removable. With such a system, the Dismounted Squire would begin without a baldric. Once a Dismounted Squire is graduated to Mounted Squire, the removable baldric could be placed on the Dismounted Squire signifying that the Squire is a Mounted Squire. A third means of distinguishing the status of a Squire is to equip each player two tokens, i.e., coin-like objects, one light 402 and one dark 403, as shown in FIG. 4, with the digraph "Kv" on one side and the digraph "Sq" on the other. Nominally, these thin tokens are circular, but can take any lamellar simply or non-simply connected two-dimensional shape. At the beginning of play, the tokens would be facing with side containing the digraph "Kv" facing upwards, indicating that the Squire is in the dismounted state, i.e., a knave. Upon graduation of either the light or dark square Squire, the token of matching color would be flipped to reveal the digraph "Sq", indicating it is in the mounted state.

Nevertheless, due to the aspect of the Squire that places him on light or dark squares for the entire game, and given that only two squires are generally allowed in a game, it is straightforward to keep track of the Squire that has been promoted from a Dismounted to a Mounted Squire. If, however, Pawns are permitted to be promoted to Squires, then a visual distinction would be required to make the game playable as it would potentially allow more than two types of Squires.

This aspect of graduation also permits another variant of the movement of the Dismounted Squire. In such a variant, the Dismounted Squire is forbidden from moving backward. Only upon graduation to a Mounted Squire is he permitted backward motion. Essentially, this eliminates two diagonal and one orthogonal move option from the Dismounted Squire. It also affects the strategy of progressing toward a graduation. If the Dismounted Squire starts the game in the second rank, alongside the Pawns, then it requires three forward moves for the piece to be promoted on a standard 8 by 8 board. If, in this configuration, the Dismounted Squire makes a capture by a diagonal move and capturing moves are disjoint from positional moves, he will not be able to be promoted until he captures an additional time. In other words, in an embodiment where diagonal capturing moves are disjoint from positional moves, an even number of captures are a necessary condition for its graduation if the Dismounted Squire starts in the second rank. This is another aspect in which the Squire's Chess variant allows for greater strategic depth, not by permitting a wider range of moves, but rather, by restricting them.

Another graduation rule, similar to the one above, permits a change in the rules governing the means of the orthogonal motion of the Squire. In one embodiment, for example, before graduation, the Dismounted Squire's orthogonal moves are limited to a march; however, after graduation the Mounted Squire orthogonal moves become a jump.

A further graduation rule pertains to the scope of graduation. In one embodiment, a Squire graduates only if he reaches the final rank. This type of graduation is referred to as a specific graduation. In other embodiment, if one of a player's Squire reaches the final rank, all of his Squires graduate from that point onward. This type of graduation is referred to as universal. Here again, the difference in the graduation scope greatly affects the strategy of the play. If the graduation is universal, a Squire is more likely to be sacrificed at the final rank if another Squire is in a position where the difference in his tactical strength as a dismounted versus mounted Squire is critical to the outcome of the game.

Yet another graduation rule, similar to the one above, can be embodied not by changing the rules of motion upon graduation from a Dismounted to a Mounted Squire, but rather the capture rules. In one embodiment the Dismounted Squire direction for which captures are permitted could be limited to only diagonal moves before graduation, whereas upon graduation the Mounted Squire could be permitted to capture for any move.

One final variant of play with the Squires is to permit its initial position to be randomized. If the Squire's initial position is in the first rank, then, as in Fischer Random chess, its initial position can be randomized with the other pieces, provided that the two Squires are on squares of opposite color. If, however, the Squire's initial position is on the second rank, then the variant would the Squire's initial position would be randomized on the second rank, with the only restriction that the two Squires are on squares of opposite color. Randomizing the Squires initial position on the second rank may or may not be accompanied with randomization of the pieces on the first rank.

In the description above we have noted a number of subvariants within the play given the movement template of the Squire: 1) capturing move restrictions, 2) jumping vs marching in the orthogonal two-square move, 3) graduation from one type of Squire to another upon arrival at the final rank, i.e., from a Mounted Squire to a Dismounted Squire, 4) the ability to capture and be captured en passant, 5) the ability for a Pawn to be promoted to a Mounted Squire, 6) the restriction of the motion of a Dismounted Squire to non-backward motion until graduation, 7) the change of the orthogonal movement type (marching to jumping) of a Dismounted Squire upon graduation, 8) the change of the capture rules of a Dismounted Squire to include orthogonal capture upon graduation, 9) rules involving randomization of the Squires position on both the first and second rank. It should not be construed by this description of the play that all these aspects must be active in a game of Squire's Chess. Any combination of these subvariants may be employed. It is anticipated that over time, a set of norms for these 9 potential variants will be standardized as to optimize both the strategic balance and the relative simplicity of the game. Examples of two combinations of these subvariants are as follows.

In one embodiment, the initial board is set up as a standard game using a standard 8 by 8 chess board. Two Dismounted Squires 401 replace two Pawns directly in front of the Bishops, as depicted in FIG. 4. Note that the Dismounted Squires are designated with the digraph "Kv", i.e., Knave. As with the Pawns, the Dismounted Squires are permitted to only capture diagonally, they are limited to moving only in the forward or sideways direction as a march. For this embodiment, the opening play continues very much like standard chess. However, as the game proceeds, the ability of the Dismounted Squire to guard more squares enables more stable outposts for other pieces becomes evident. For example, this allows the player to shore up Pawn islands that become vulnerable during play. In a sense, for this embodiment the Squire acts as a reconfigurable pawn. If graduation is allowed for the Dismounted Squire, i.e., that the Dismounted Squire is promoted to a Mounted Squire upon reaching the final rank, then for this embodiment its two-square orthogonal motion could change from a march to a jump, with all eight orthogonal and diagonal movements are permitted wherein capturing is only allowed for the orthogonal moves. With this graduation option, the strategy changes in such a way that favors quick and active development of the Squire as opposed of a more defensive role.

Figure 5:
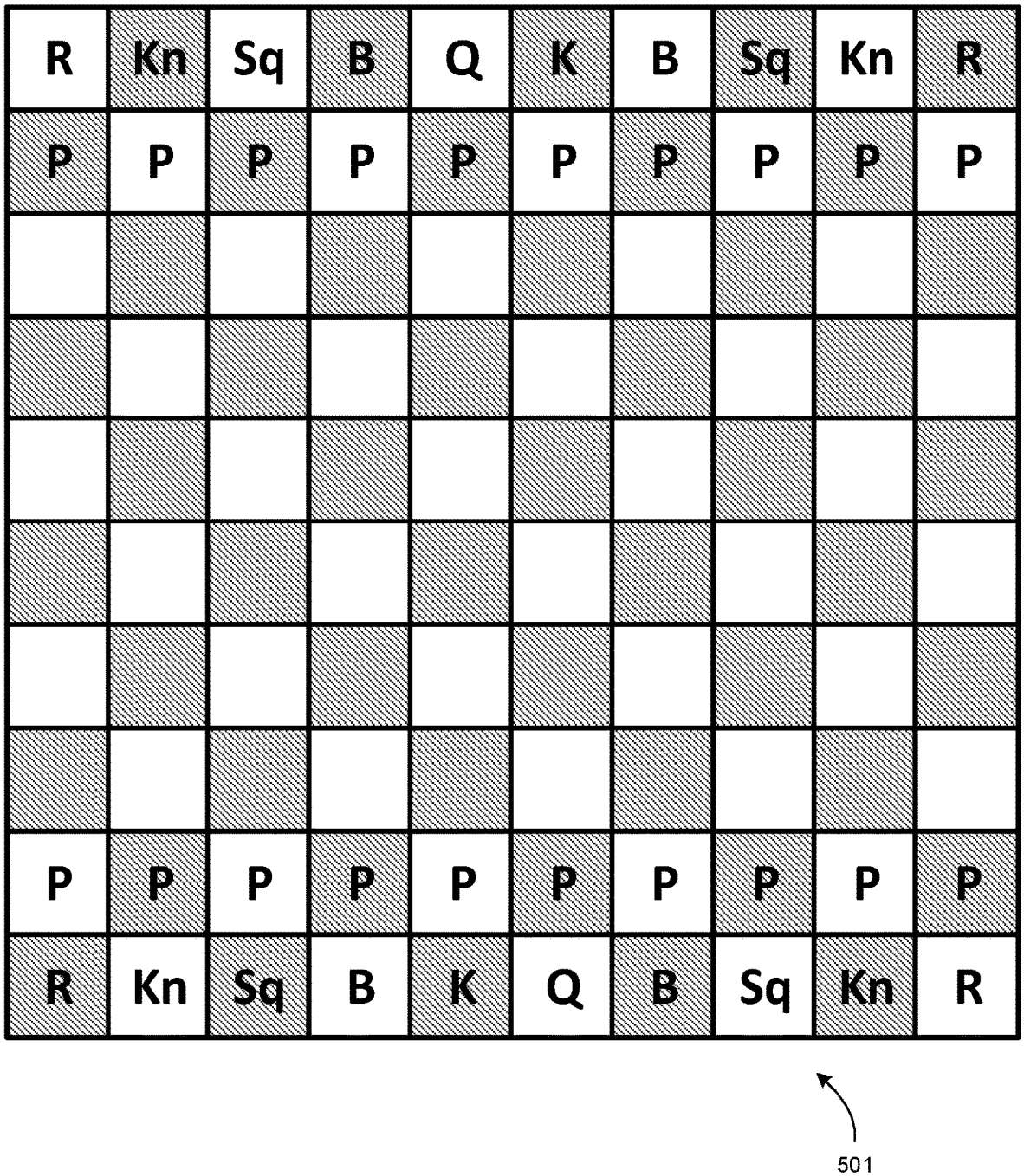
FIG. 5 depicts an initial layout of a ten by ten chess board with the novel non-conventional chess piece.

In another embodiment, the initial board is set up using 10 by 10 or a 10 by 8 chess board. The second rank for both players contains only Pawns. The ordering of the first rank follows much as standard chess with a gap between the Bishop and the Knight filled with a Mounted Squire 501, e.g., R-Kn-Sq-B-K-Q-B-Sq-Kn-R, as shown in FIG. 5. Note that the Mounted Squires are designated with the digraph "Sq". In this embodiment the Squire starts off as a Mounted Squire, being able to jump over Pawns in the second rank. Furthermore, this Squire is equipped with capture rules that enable it to move and capture both orthogonally and diagonally. As with standard chess, this initial setup is configured such that all the Pawns on the second rank are guarded by the pieces on the first rank as the game starts. Note, too, that this configuration requires the Player to make a tactical choice on which piece, the Knight or the Squire, to develop first when moving two squares directly in front of the Squire. It is not, however, to be construed that if the Squire starts off in the first rank that he must be a Mounted Squire and that the process of graduation is foregone. Any permissible variant may be allowed based on the strategic balance that one wishes to create.

Figure 6:
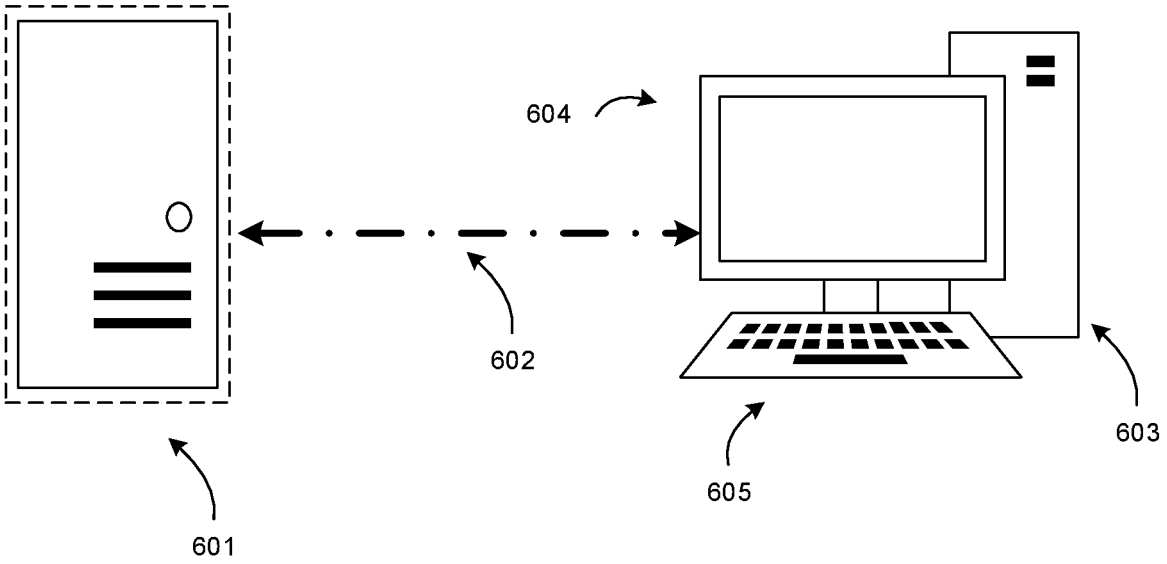
FIG. 6 depicts how the play of the chess variant described herein may be facilitated by a computational device or a set of networked computational devices.

One area in which the field of chess has seen significant growth has been online and computer-assisted chess playing. Many websites devoted to chess play, news, and analysis have been founded. These websites not only permit online players to play against one another, but also to play against computational engines these websites employ to act as an opponent. For many of these websites, there already exist options to play not just standard chess but a variety of chess variants. It is envisioned that the chess variant described herein could be one such variant that online sites provide to their users. It could be implemented by the apparatus described in FIG. 6. A centralized server 601 would interact via a network connection 602 with a user's client such as personal computer 603 and displayed on a visualization device, such as a computer monitor 604 with input provided by an input device such as a keyboard 605, mouse, touchpad, microphone, camera, or any other suitable input device. The processing of the game may be distributed between the server and client. Additionally, it is envisioned that the chess variant herein could be provided as a standalone app or computer program, enabling a player to play the variant entirely on his computer, smart phone, or other computational device.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A method of playing an expanded chess-like game for use by a first player against a second player, comprising the steps of: providing a game board or facsimile with alternate light-colored and dark-colored squares, arranged in adjacent vertical and horizontal rows, each of said rows including said alternate light-colored and dark-colored squares, each square offset with respect to the similarly-colored square of the adjacent row, to form a checkerboard pattern of bilaterally alternating colored squares, said game board having at least eight and fewer than eleven horizontal rows and vertical columns; providing a plurality of playing pieces, including one set of light-colored pieces for a first player and one set of dark-colored pieces for a second player, each set of pieces comprising six to ten Pawns, one King, one Queen, two Rooks, two Bishops, two Knights, and two of a new separate game piece which is visually distinguishable from the others; formatting predetermined rules of movement for play wherein each of the Kings, the Queens, the Rooks, the Bishops, the Knights, and the Pawns have the same rules of movement and capturing as the corresponding piece in standard chess; and formatting a set of predetermined rules of movement for the new separate game pieces wherein it is permitted to move in a complete set and subset of eight potential moves that include a movement of two squares in an orthogonal direction and movement of one square in a diagonal direction provided that square is unoccupied by another piece of the same color, wherein the new separate game pieces are permitted to capture an opponent's piece on a complete set and subset of these eight potential moves; wherein the new separate game pieces include a grooved top portion representing a visor.

2. The method of claim 1, wherein the new separate game pieces are permitted to move on a complete set or subset of the aforementioned eight potential moves only if the square to be moved to is occupied by an opponent's piece.

3. The method of claim 1, wherein the orthogonal moves of two squares of the new separate game pieces are permitted to move even when its path is impeded with an opponent's piece on an orthogonal square adjacent to the new separate game piece in the direction of play.

4. The method of claim 1, wherein the two new separate game pieces occupy the squares on the first rank and on opposite colors on a playing board of size 8 by 10 or 10 by 10 squares along with a set of standard chess pieces, ordered as in standard chess with the new piece occupying a vacant spot between similar pieces of the sets.

5. The methods of claim 4, wherein the two of the new separate game pieces initially occupy random positions in the first rank, each located on a different colored square.

6. The method of claim 3, wherein the new separate game pieces are referred to as a Mounted Squire or a Squire.

7. The method of claim 1, wherein the movement of two squares in an orthogonal direction is permitted only when its path is unimpeded, wherein an opponent's piece is not on an orthogonal square adjacent to the new separate game piece in the intended direction of play.

8. The method of claim 7, wherein the opponent is permitted to capture the new separate game pieces en passant immediately after an orthogonal move is played, after which the capturing piece would occupy the square immediately between the starting and ending point of the previous two square move of the new separate game piece.

9. The method of claim 8 wherein only a Pawn is permitted to capture the new separate games piece en passant.

10. The method of claim 1, wherein the two new separate game pieces occupy squares on the second rank on opposite colors on a playing board of size 8 by 8 squares at the outset of the game.

11. The method of claim 1, wherein the two new separate game pieces occupy random positions in the second rank, each located on a different colored square.

12. The method of claim 7, wherein the new separate game pieces are referred to as a Dismounted Squire or a Knave.

13. The method of claim 1, wherein the movement and capture rules governing the new separate game pieces undergoes a change upon reaching a final rank, wherein the change is denoted as a graduation.

14. The method of claim 1, wherein the movement and capture rules governing the new separate game pieces undergo a change when any one of the new separate game pieces reaches a final rank, wherein the change is denoted as a universal graduation.

15. The method of claim 1, wherein a Pawn is permitted to be promoted to a new separate piece upon reaching a final rank.

16. The method of claim 1, wherein the new separate game pieces include a circumferential band above a base, representing a baldric, wherein the baldric may be fixed or removable.

17. The method of claim 1, wherein the game includes a thin, shaped token associated with each of the new separate game pieces, wherein a first thin, shaped token associated with a first of the new separate game pieces is lightly colored, wherein a second thin, shaped token associated with a second of the new separate game pieces is darkly colored, wherein a first side of each of the thin, shaped tokens is marked with a first symbol, wherein a second side of each of the thin, shaped tokens is marked with a second symbol different from the first symbol, and wherein the first symbol indicates a first status of the new separate game piece, and wherein the second symbol indicates a second status of the new separate game piece, the second status different from the first.

18. The method of claim 1, wherein the game play is facilitated by a computational device or networked computational devices with desired moves facilitated by an input device and with game state displayed on a visualization device.

* * * * *